US006981610B2

(12) United States Patent
Smiley et al.

(10) Patent No.: US 6,981,610 B2
(45) Date of Patent: Jan. 3, 2006

(54) DISPENSER FOR A PAPER PRODUCT

(75) Inventors: Charles F. Smiley, Waunakee, WI (US); Michael A. Ecksein, Poynette, WI (US)

(73) Assignee: Traex Company, Toledo, OH (US)

( * ) Notice: Subject to any disclaimer, the term of this patent is extended or adjusted under 35 U.S.C. 154(b) by 54 days.

(21) Appl. No.: 10/797,802

(22) Filed: Mar. 10, 2004

(65) Prior Publication Data

US 2005/0199643 A1 Sep. 15, 2005

(51) Int. Cl.
*B65H 1/00* (2006.01)

(52) U.S. Cl. ..... 221/33; 221/47; 221/63
(58) Field of Classification Search ..... 221/63, 221/56, 59, 47, 48, 33
See application file for complete search history.

(56) References Cited

U.S. PATENT DOCUMENTS

| | | | | |
|---|---|---|---|---|
| 4,706,844 | A * | 11/1987 | Omdoll et al. | 221/59 |
| 4,838,454 | A * | 6/1989 | Salzmann et al. | 221/57 |
| 4,953,746 | A * | 9/1990 | Andriash | 221/35 |
| 5,102,007 | A * | 4/1992 | Petterson et al. | 221/6 |
| 5,137,173 | A * | 8/1992 | Hughes et al. | 221/34 |
| 6,585,129 | B2 | 7/2003 | Moody et al. | |
| 6,622,888 | B2 | 9/2003 | Boone et al. | |
| 2001/0023874 | A1 * | 9/2001 | Niada | 221/63 |
| 2002/0179624 | A1 * | 12/2002 | Tramontina | 221/33 |
| 2003/0062375 | A1 * | 4/2003 | Christensen et al. | 221/46 |
| 2004/0020936 | A1 * | 2/2004 | Guillemette et al. | 221/47 |

* cited by examiner

*Primary Examiner*—David H. Bollinger
(74) *Attorney, Agent, or Firm*—MacMillan, Sobanski & Todd, LLC

(57) ABSTRACT

A dispenser for a paper product having a faceplate defining a slot including a center portion, a first end and a second end. The center portion is larger than the first and second ends. The faceplate has a plurality of outwardly projecting lips positioned adjacent to the center portion for engaging a person's fingers to limit access to a paper product being dispensed through the slot.

9 Claims, 9 Drawing Sheets

DISPENSER FOR A PAPER PRODUCT

BACKGROUND OF THE INVENTION

The present invention relates generally to a dispenser for a paper product. More specifically, the invention is directed to a napkin dispenser having a faceplate including a limited access slot.

Prior napkin dispensers have faceplates including an opening through which napkins are dispensed. These dispensers do not include any effective means to limit access to the napkins by a person using the dispenser. This allows the user to remove many napkins through the opening at one time. Sometimes the user removes more napkins than what is required for use. This results in excess waste, increased material and labor costs for servicing the dispenser and a higher probability of no napkins being available to subsequent users.

It has been found that there is a need for a dispenser for a paper product such as a napkin that limits the number of napkins that can be removed by a user from the dispenser. The present invention satisfies this need.

SUMMARY OF THE INVENTION

A dispenser for a paper product having a faceplate defining a slot having a center portion, a first end and a second end. The center portion of the slot being larger than the first and second ends. The faceplate has a plurality of outwardly projecting lips positioned adjacent to the center portion for engaging a person's fingers to limit access to a paper product being dispensed through the slot.

The primary object of the present invention is to provide a dispenser for a paper product that limits access to the paper product by a user of the dispenser.

Other objects and advantages of the present invention shall become apparent to those skilled in the art upon a review of the following detailed description of the preferred embodiments and the accompanying drawings.

DETAILED DESCRIPTION OF THE PREFERRED EMBODIMENTS

Figure 1:
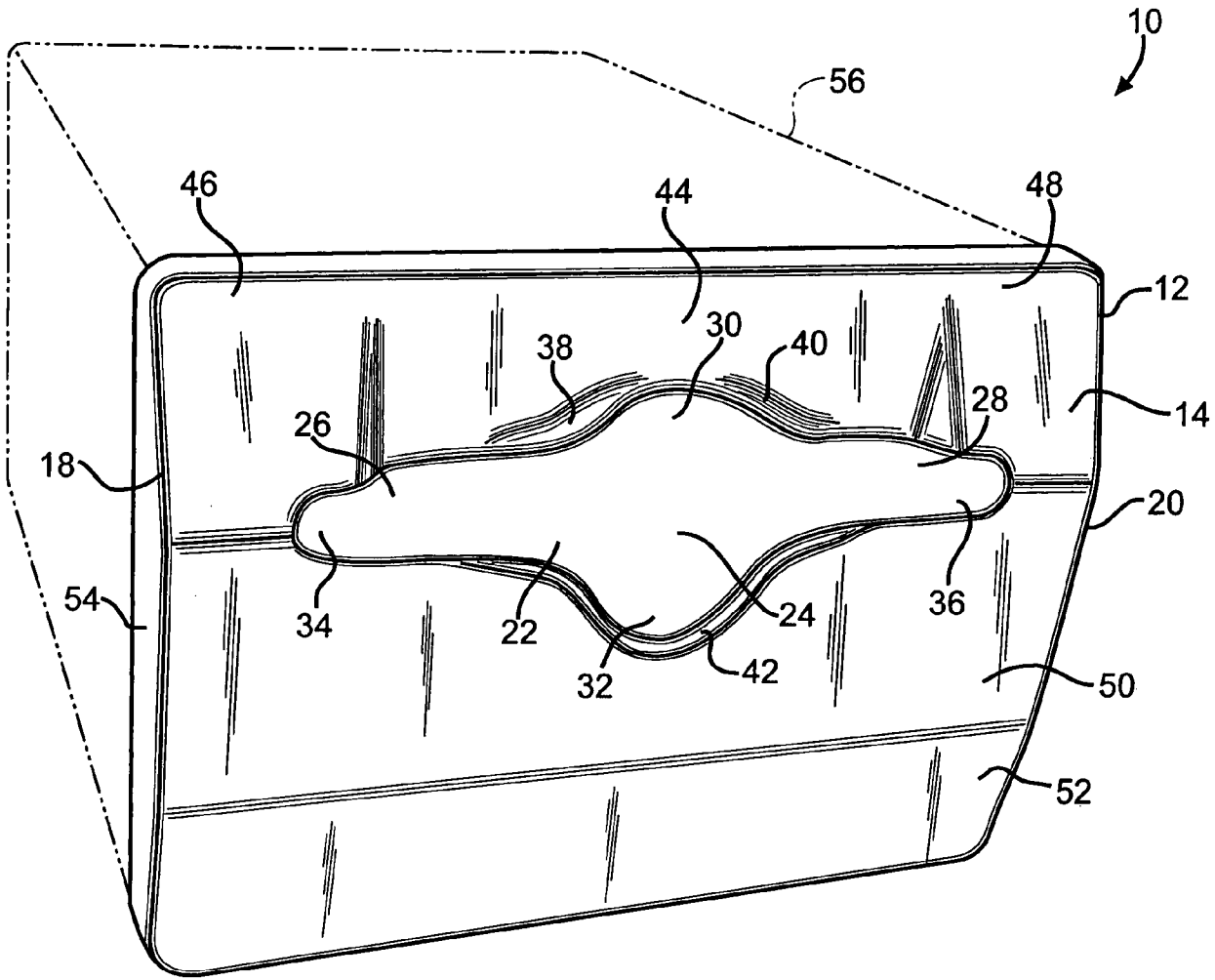
FIG. 1 is a front perspective view of a dispenser for a paper product according to the present invention; a container for the paper product is represented in broken lines in the drawings.

The preferred embodiments and best mode of the present invention will now be described in detail with reference being made to the drawings, which form a portion of the disclosure. In the drawings, the dispenser of the present invention is indicated generally by the reference number "10".

Referring to FIGS. 1–6, the dispenser 10 has a faceplate 12 having a front 14, a back 16, a first side 18 and a second side 20. The faceplate 12 defines a slot 22 having a center portion 24, a first end 26 and a second end 28. As shown in FIG. 1, the slot 22 extends longitudinally between the first and second ends 26 and 28. The center portion 24 has a rounded upper portion 30 and an opposed rounded lower portion 32. The first end 26 of the slot 22 has a rounded first end portion 34. The second end 28 of the slot 22 has a rounded second end portion 36.

Figure 2:
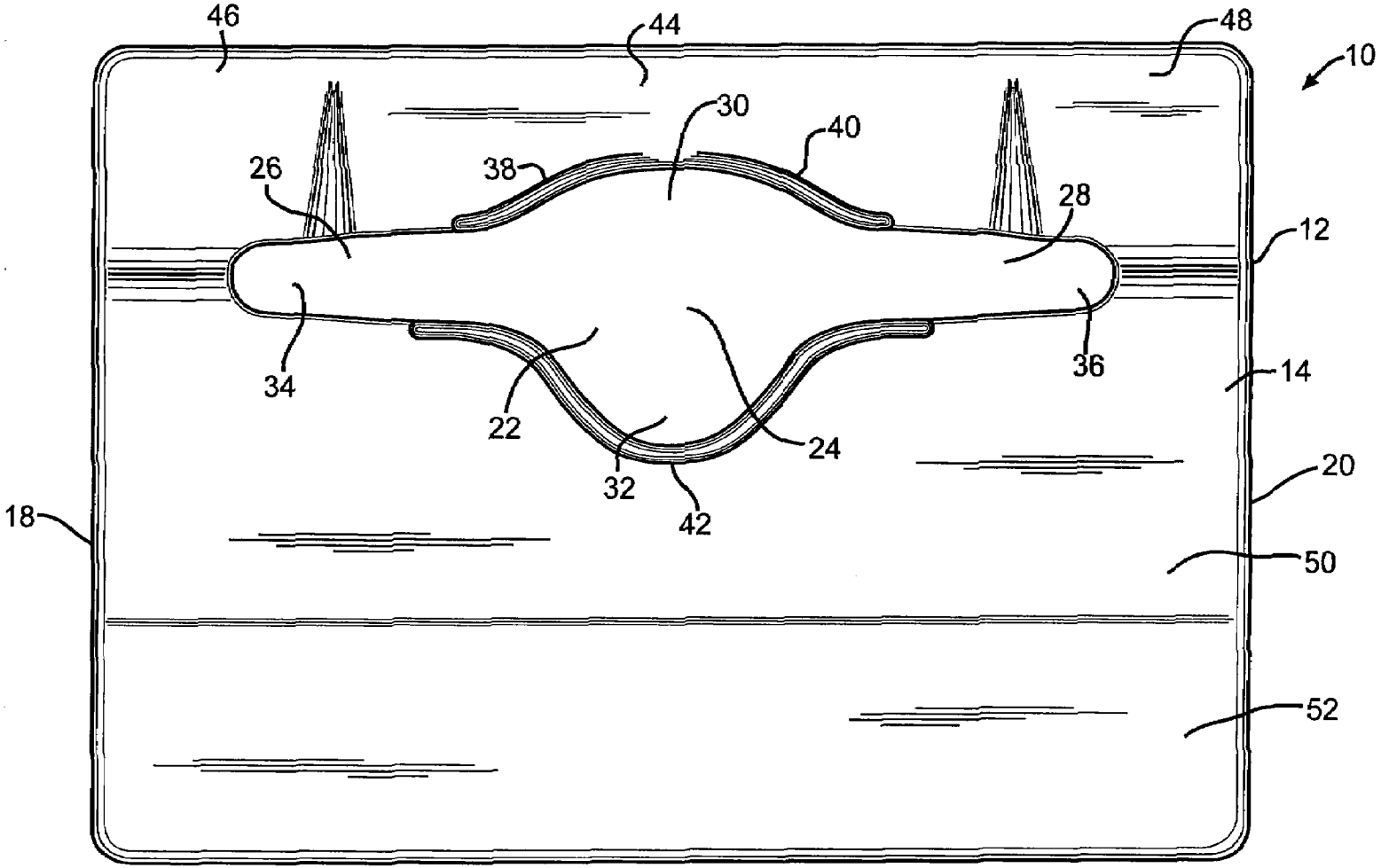
FIG. 2 is a front elevational view of a faceplate according to the present invention.
Figure 3:
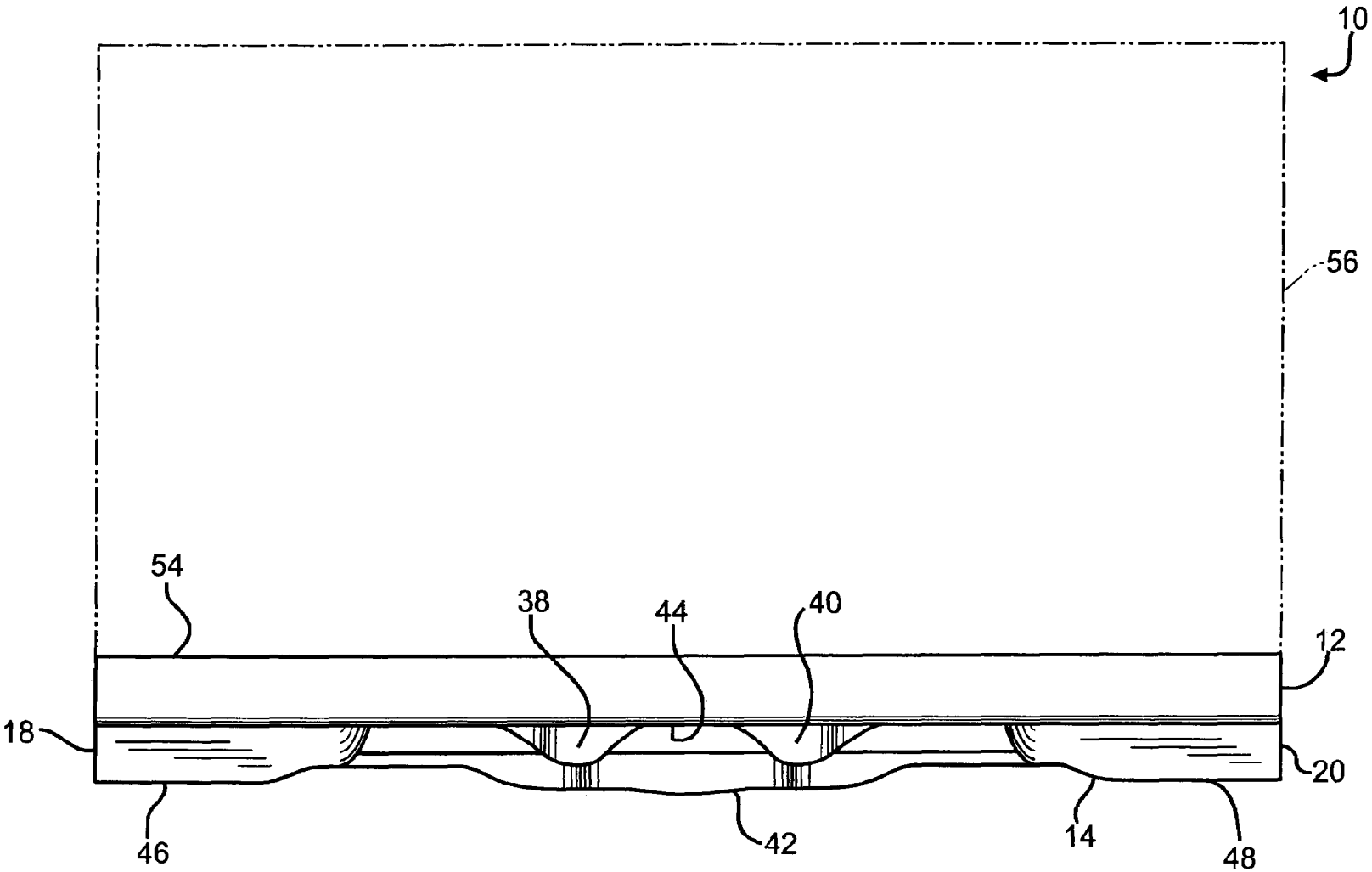
FIG. 3 is a top view thereof.
Figure 4:
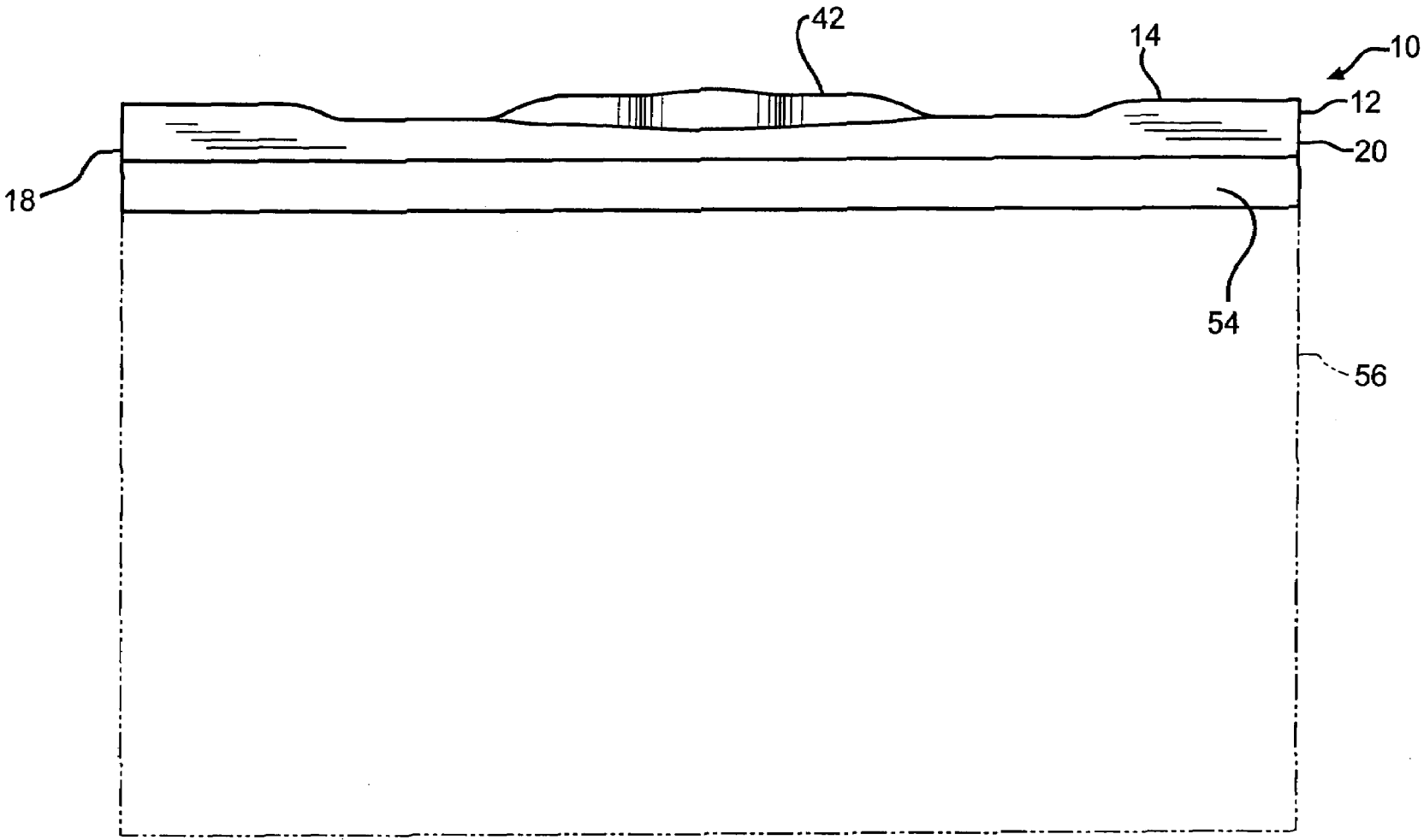
FIG. 4 is a bottom view thereof.
Figure 5:
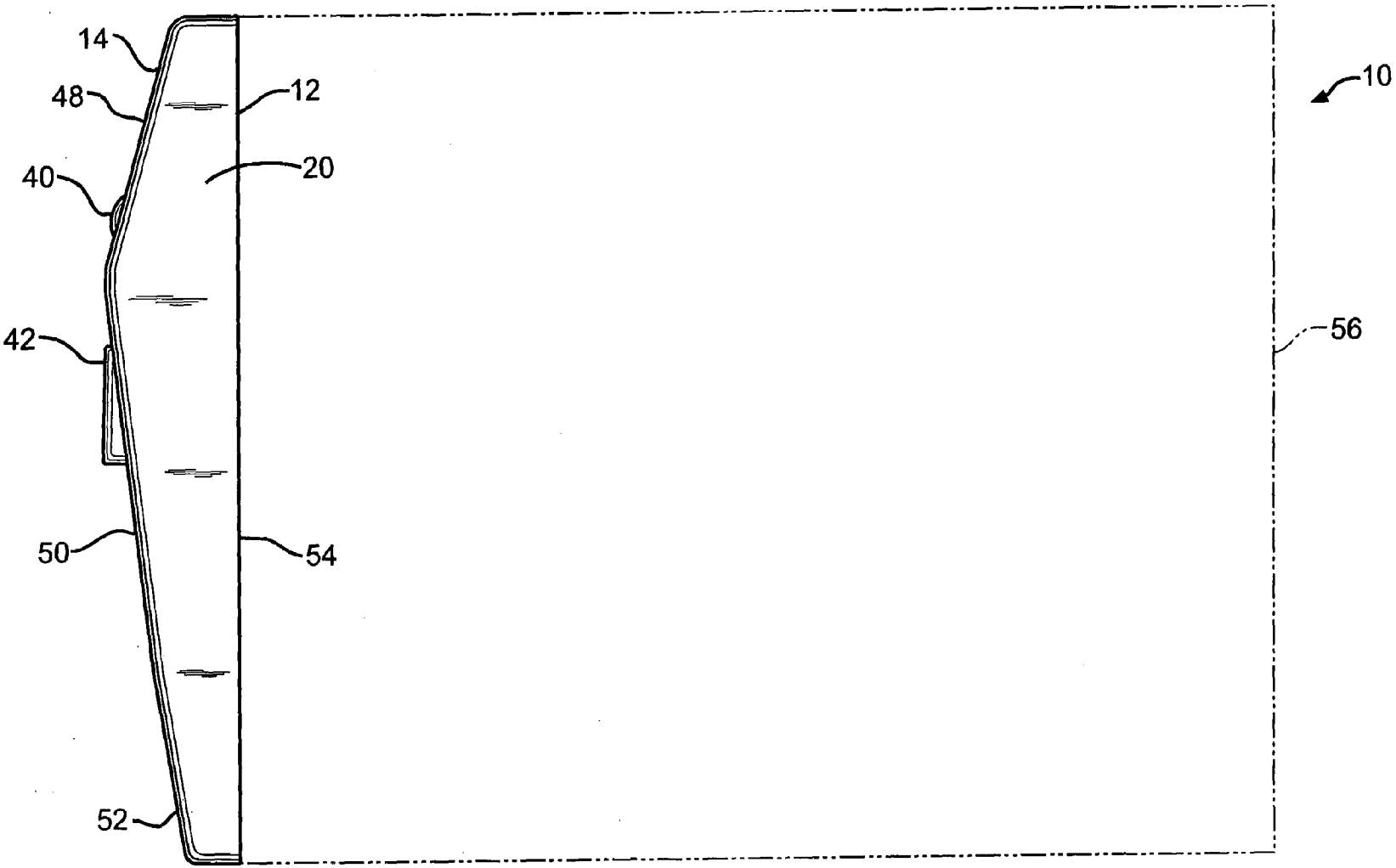
FIG. 5 is a side elevational view thereof; the other side view being a mirror image.
Figure 6:
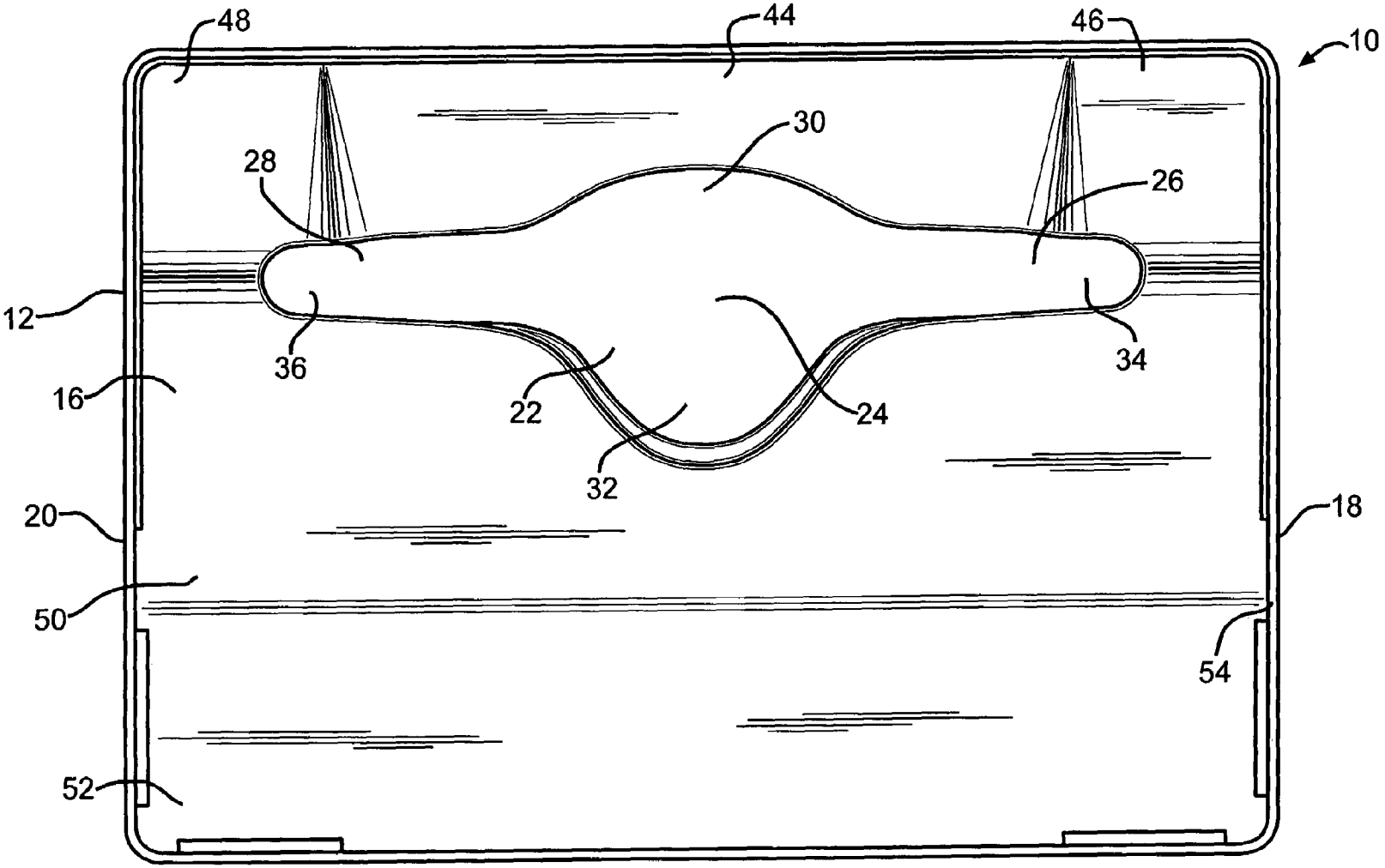
FIG. 6 is a back elevational view thereof.

Still referring to FIGS. 1–6, the faceplate 12 includes a first upper lip 38 and a second upper lip 40 positioned adjacent to the upper portion 30 of the slot 22. The faceplate 12 further includes a lower lip 42 positioned adjacent to the lower portion 32 of the slot 22. As shown in FIG. 2, the first and second upper lips 38 and 40 have shapes that correspond to the shape of the upper portion 30 of the slot 22. The lower lip 42 has a shape that corresponds to the shape of the lower portion 32. The first and second upper lips 38 and 40 and the lower lip 42 project outwardly from the faceplate 12 as shown in FIGS. 3, 4 and 5.

As shown in FIG. 2, the faceplate 12 includes a flat surface 44 positioned between a first top sloped surface 46 and a second top sloped surface 48. The flat surface 44 is positioned adjacent to the upper portion 30 of the slot 22.

Still referring to FIG. 2, the faceplate 12 includes a first bottom sloped surface 50 and a second bottom sloped surface 52. The first bottom sloped surface 50 is positioned adjacent to the lower portion 32 of the slot 22. Still referring to FIGS. 1–6, the faceplate 12 includes a flange 54 that projects outwardly from the back 16 of the faceplate 12. The flange 54 is sized and adapted to attach the faceplate 12 to a paper product container 56 that is represented in broken lines in the drawings.

Figure 7:
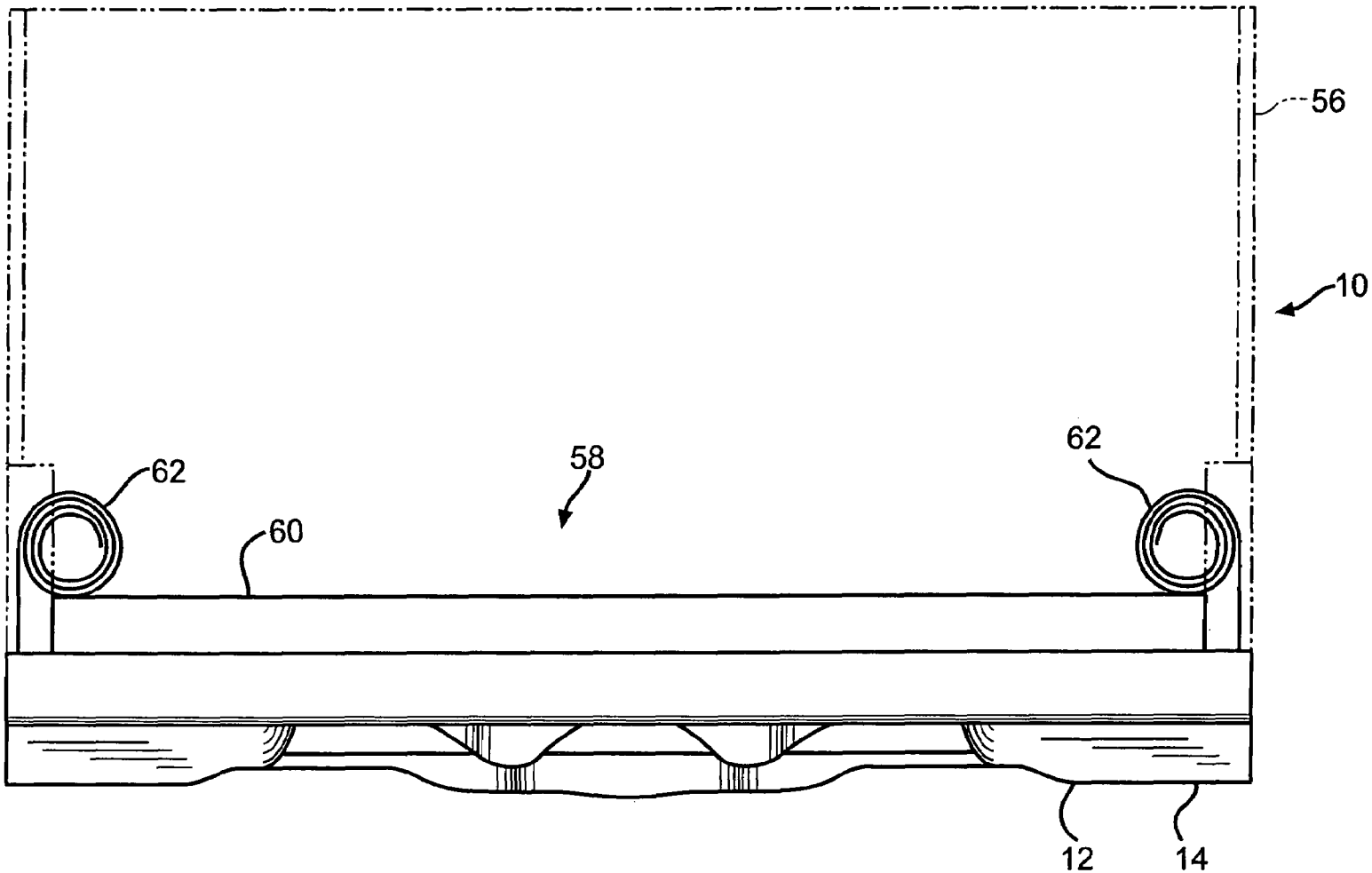
FIG. 7 is a top view of the dispenser according to the present invention showing a push plate assembly in relation to the faceplate according to the present invention.

As shown in FIG. 7, the dispenser 10 has a push plate assembly 58 positioned in the container 56. The push plate assembly 58 includes a push plate 60 and a spring 62. The spring 62 biases the push plate 60 toward the faceplate 12. In an alternative embodiment, the dispenser 10 can use gravity force without spring biasing.

The faceplate 12 of the dispenser 10 is sized and adapted to limit access to the slot 22 by the fingers of a user, especially the use of the index finger and the thumb in a pinching motion. In this regard, the slot 22 is sized and adapted so that the center portion 24 is larger than the first and second ends 26 and 28. The center portion 24 is sized to allow only limited space for a person's fingers. Further, the outwardly projecting lips 38, 40 and 42 engage the user's fingers to limit access through the slot 22. The first and second ends 26 and 28 are sized and adapted to limit access while allowing passage of a paper product.

Figure 8:
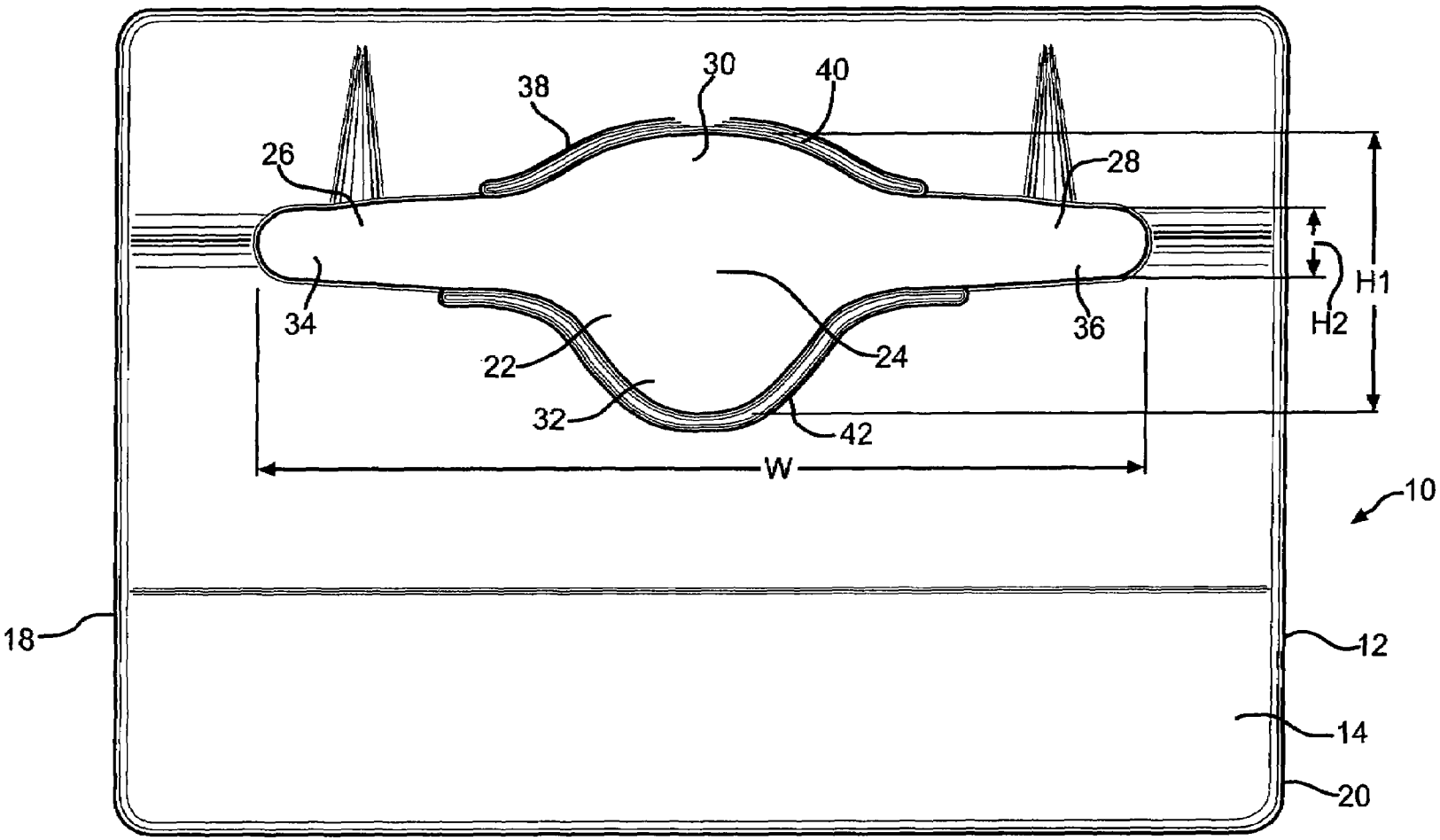
FIG. 8 is a front elevational view of the faceplate according to the present invention showing various dimensions.
Figure 9:
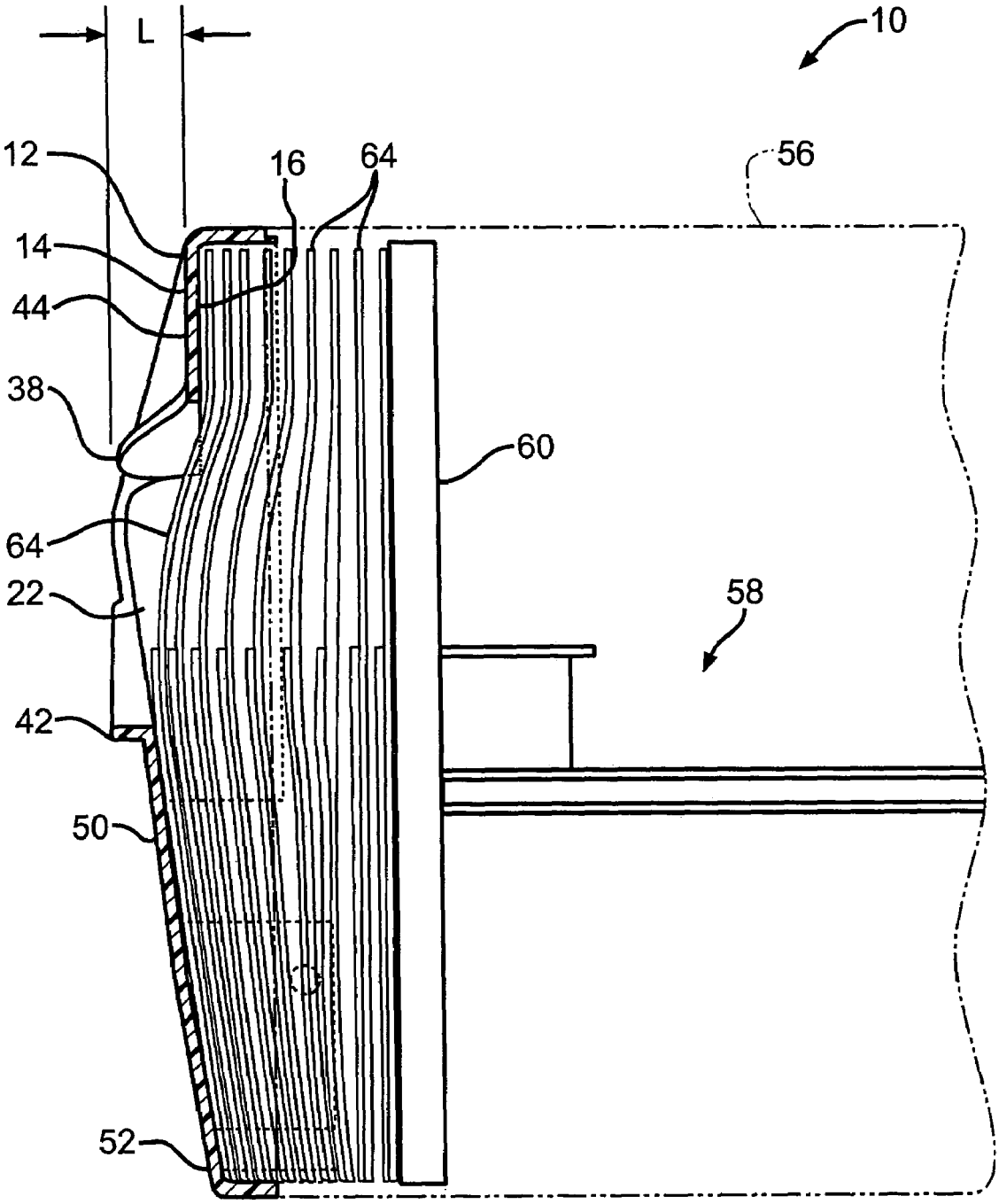
FIG. 9 is a cross-sectional view taken through the center of the dispenser according to the present invention in which napkins are shown positioned adjacent to the back of the faceplate according to the present invention.

In a preferred embodiment as shown in FIGS. 8 and 9, the slot 22 has a width W of 6 inches. The center portion 24 has a height H1 of 1⅞ inches. The first and second ends 26 and 28 have a height H2 of ½ inch at the first and second end portions 34 and 36. Referring to FIG. 9, the lips 38, 40 and 42 project outwardly from the front 14 of the faceplate 12 a length L of ½ inch in relation to the flat surface 44. These dimensions can vary depending on the size and shape of the faceplate 12.

As shown in FIG. 9, a stack of interlaced paper napkins 64 are positioned in the container 56 between the back 16 of the faceplate 12 and the push plate 60. The force exerted by the push plate 60 causes the napkins 64 to be bowed slightly adjacent to the slot 22 due to engagement with the surfaces 44–52 of the faceplate 12. The slot 22 and lips 38–42 act to limit access to the napkins 64 by engaging the fingers of a user. It has been found that in most cases fewer than three napkins 64 can be removed through the slot 22 at one time.

In a preferred embodiment, the faceplate 12 is constructed of metal for durability and strength. In alternative embodiments, the faceplate 12 can be constructed of a plastic material for durability and strength. In addition to the above-described functional features, the dispenser of the present invention has a pleasing appearance.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A dispenser for a paper product comprising:

a faceplate defining a slot having a center portion, a first end and a second end, said center portion being larger than said first and second ends, said slot extending longitudinally between said first and second ends, said center portion having a rounded upper portion and an opposed rounded lower portion, said first end having a rounded first end portion and said second end having a rounded second end portion, said faceplate having a first upper lip and a second upper lip positioned adjacent to said upper portion and a lower lip positioned adjacent to said lower portion, said first and second upper lips being spaced from one another, said first and second upper lips and said lower lip projecting outwardly from said faceplate, said faceplate having a flat surface between a first top sloped surface and a second top sloped surface positioned adjacent to said upper portion and a bottom sloped surface positioned adjacent to said lower portion, said first and second upper lips, said lower lip and said first and second ends being sized and adapted for engaging a person's fingers to limit access to a paper product being dispensed through said slot.

2. The dispenser of claim 1, wherein said faceplate includes at least one member for attaching said faceplate to a paper product container.

3. The dispenser of claim 1, wherein said faceplate is positioned adjacent to a push plate assembly.

4. The dispenser of claim 1, wherein said faceplate is constructed of metal.

5. The dispenser of claim 1, wherein said faceplate is constructed of plastic.

6. The dispenser of claim 1, wherein said faceplate has a second bottom sloped surface positioned adjacent to said bottom sloped surface.

7. The dispenser of claim 1, wherein said faceplate has an outwardly projecting flange for attaching said faceplate to a container for a paper product.

8. The dispenser of claim 1, wherein said dispenser has a push plate assembly having a push plate for a paper product and a spring for biasing said push plate toward said faceplate.

9. A dispenser for a paper product comprising:

a faceplate defining a slot having a center portion, a first end and a second end, said center portion being larger than said first and second ends, said slot extending longitudinally between said first and second ends, said center portion having a rounded upper portion and an opposed rounded lower portion, said first end having a rounded first end portion and said second end having a rounded second end portion, said faceplate having a first upper lip and a second upper lip positioned adjacent to said upper portion and a lower lip positioned adjacent to said lower portion, said first and second upper lips being spaced from one another, said first and second upper lips and said lower lip projecting outwardly from said faceplate, said faceplate having a flat surface between a first top sloped surface and a second top sloped surface positioned adjacent to said upper portion and a bottom sloped surface positioned adjacent to said lower portion, said first and second upper lips, said lower lip and said first and second ends being sized and adapted for engaging a person's fingers to limit access to a paper product being dispensed through said slot, said faceplate having an outwardly projecting flange for attaching said faceplate to a container for a paper product; and a push plate for a paper product and a spring for biasing said push plate toward said faceplate.

* * * * *